United States Patent [19]

Kelley

[11] Patent Number: 4,544,478

[45] Date of Patent: Oct. 1, 1985

[54] PROCESS FOR PYROLYZING HYDROCARBONACEOUS SOLIDS TO RECOVER VOLATILE HYDROCARBONS

[75] Inventor: Max D. Kelley, Albany, Calif.

[73] Assignee: Chevron Research Company, San Francisco, Calif.

[21] Appl. No.: 591,639

[22] Filed: Mar. 20, 1984

Related U.S. Application Data

[63] Continuation of Ser. No. 414,712, Sep. 3, 1982, abandoned.

[51] Int. Cl.[4] ..... C10G 1/00

[52] U.S. Cl. ..... 208/11 R; 208/8 R

[58] Field of Search ..... 208/8 R, 11 R; 201/21, 201/24, 26, 31

[56] References Cited

U.S. PATENT DOCUMENTS

| | | | |
|---|---|---|---|
| 2,582,712 | 1/1952 | Howard | 208/11 R |
| 2,614,069 | 10/1952 | Matheson | 201/21 X |
| 3,004,898 | 10/1961 | Deering | 208/11 R |
| 3,008,894 | 11/1971 | Culbertson, Jr. | 208/11 |
| 3,133,010 | 5/1964 | Irish et al. | 208/11 R |
| 3,655,518 | 4/1972 | Schmalfold et al. | 208/11 R X |
| 3,703,442 | 11/1972 | Rammler et al. | 201/12 |
| 3,817,723 | 6/1974 | Donath | 208/8 R |
| 3,836,435 | 9/1974 | Skornyakov et al. | 208/8 R X |
| 3,925,190 | 12/1975 | Whitcombe et al. | 208/11 R |
| 4,118,201 | 10/1978 | Yan | 208/8 R X |
| 4,133,739 | 1/1979 | Mitchell et al. | 201/31 X |
| 4,141,794 | 2/1979 | Choi | 201/21 X |
| 4,199,432 | 4/1980 | Tamm et al. | 208/8 R |
| 4,336,128 | 6/1982 | Tamm | 208/11 R |
| 4,366,043 | 12/1982 | Chukhanov et al. | 208/8 R |
| 4,384,947 | 5/1983 | Van Zanten | 208/11 R |
| 4,385,983 | 5/1983 | Rosenthal et al. | 208/11 R |
| 4,415,433 | 11/1983 | Hoekstra | 208/8 R X |

*Primary Examiner*—D. E. Gantz
*Assistant Examiner*—Glenn A. Caldarola
*Attorney, Agent, or Firm*—S. R. La Paglia; W. K. Turner; Q. T. Dickinson

[57] ABSTRACT

Hydrocarbonaceous solids are pyrolyzed in a process employing a series of alternate pyrolysis zones and combustion zones preferably arranged along an incline. In particular, low grade hydrocarbonaceous solids are employed to supplement combustion in these alternating combustion zones.

18 Claims, 1 Drawing Figure

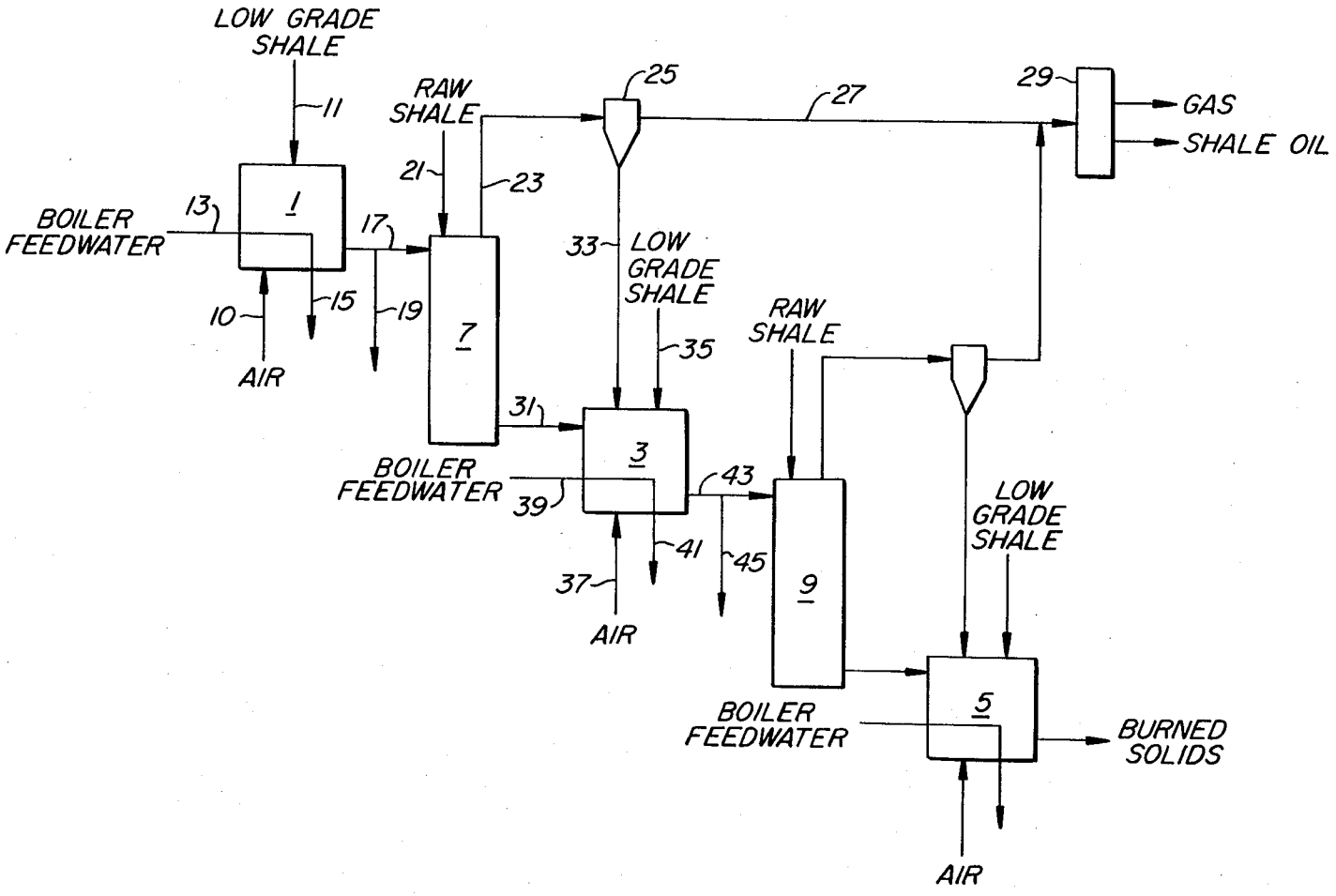
LOW GRADE SHALE
11
1
13
BOILER FEEDWATER
10
AIR
15
17
19
RAW SHALE
21
23
7
25
27
29
GAS
SHALE OIL
LOW GRADE SHALE
33
35
3
31
BOILER FEEDWATER
39
37
AIR
41
43
45
RAW SHALE
9
LOW GRADE SHALE
5
BOILER FEEDWATER
AIR
BURNED SOLIDS

PROCESS FOR PYROLYZING HYDROCARBONACEOUS SOLIDS TO RECOVER VOLATILE HYDROCARBONS

CROSS REFERENCE TO RELATED APPLICATION

This application is a continuation of my application Ser. No. 414,712, filed Sept. 3, 1982, now abandoned.

BACKGROUND OF THE INVENTION

Certain naturally occurring materials contain a hydrocarbonaceous component which upon heating will release a hydrocarbon product which is useful as a feedstock in petroleum processing. These "hydrocarbonaceous solids" such as oil shale, tar sands, coal and diatomaceous earth, may be "retorted", i.e. pyrolyzed, in reactor vessels having various designs. Following the pyrolysis of the hydrocarbonaceous solid to extract the volatile components, "a pyrolyzed solid" remains which contains a carbonaceous residue which may be burned to yield heat. This heat may be used to supply heat for the pyrolysis of fresh hydrocarbonaceous solids.

The inorganic residue that remains after the combustion of this carbonaceous residue is recycled in some retorting processes as "heat transfer solids," i.e., the hot burned inorganic residue from the combustion is mixed with fresh hydrocarbonaceous solid, and the heat provided is used to heat and pyrolyze the fresh material. Alternately, the heat transfer solid may be a particulate solid other than the inorganic residue remaining after the combustion of the pyrolyzed material. Such alternate heat transfer solids include particulate solids such as, for example, ceramic compositions, sand, alumina, steel or the like. Such materials are generally heated in the combustion zone and then transferred to the pyrolysis zone either alone or mixed with the burned inorganic residue. In many instances these alternate heat transfer solids serve as supplemental heat transfer material in combination with the hot inorganic residue formed in the combustion zone.

The use of a pyrolysis zone in combination with a combustion zone is a typical feature of a number of different processing schemes for hydrocarbonaceous solids. See for example, U.S. Pat. Nos. 4,199,432; 3,703,442; and 3,008,894. In order to provide sufficient heat to produce synthetic petroleum feedstocks from the hydrocarbonaceous solids noted above, it is frequently necessary to employ supplemental fuels in the combustion zone. The design and arrangement of the process steps also is important to insure the efficient transfer of heat between the two zones. The present invention is concerned with an arrangement of process steps which are intended to make a commercial retorting operation more efficient.

SUMMARY OF THE INVENTION

The present invention is directed to a process for pyrolyzing a particulate hydrocarbonaceous solid which comprises:

(a) heating a heat transfer solid to a temperature sufficient to pyrolyze said particulate hydrocarbonaceous solid;

(b) mixing the hot heat transfer solid from step (a) with a first fraction of hydrocarbonaceous solids in a first pyrolysis zone thereby heating said first fraction of hydrocarbonaceous solids to a pyrolyzing temperature, whereby volatile hydrocarbons and pyrolyzed solids containing a carbonaceous residue are formed;

(c) recovering the volatile hydrocarbons from the first pyrolysis zone as product vapors;

(d) burning in the presence of oxygen the carbonaceous residue remaining in the pyrolyzed solids formed in step (b) in a combustion zone to form additional hot heat transfer solid;

(e) pyrolyzing a second fraction of hydrocarbonaceous solids in a second pyrolysis zone using the hot heat transfer solids of step (d) to form additional volatile hydrocarbons;

(f) recovering the volatile hydrocarbons from the second pyrolysis zone; and (g) withdrawing pyrolyzed solids and heat transfer material from the second pyrolysis zone.

In one embodiment the combustion and pyrolysis zones are arranged along an incline, whereby particulate solids passing from one zone to another are aided by gravity. Such an arrangement is particularly advantageous in processing oil shale, in that it is possible to utilize the natural contours of the land in oil shale producing areas to move mined and treated solids from one process step to the other. As will be explained below the process of this invention is also an efficient means for cogenerating steam as well as pyrolyzing hydrocarbonaceous solids.

An additional advantage is that "sour", (i.e., high sulfur, supplemental fuels such as noncondensible retort gas, sour water strippings, and/or sulfur bearing) coal may be cleanly burned in some embodiments of the invention along with the carbonaceous pyrolyzed oil shale which sorbs and retains the burned sulfur compounds as a sulfate.

In another embodiment of the invention, the heat transfer solids of step (a) are heated in a combustion zone using particulate hydrocarbonaceous solids as fuel.

BRIEF DESCRIPTION OF THE DRAWING

The FIGURE is a diagrammatic representation of the process of the invention as it may be used to recover shale oil from oil shale.

DETAILED DESCRIPTION OF THE INVENTION

The present invention may be readily understood by reference to the figure. The following decription shall be concerned with a process for pyrolyzing particulate oil shale. However, one skilled in the art will recognize that the basic process may be employed with other hydrocarbonaceous solids as well.

Three combustion zones 1, 3, and 5 are shown as alternating with two pyrolysis zones 7 and 9. Additional pyrolysis and combustion zones may be added in series or in parallel to the zones illustrated, but for the sake of simplicity only a total of five alternating zones are shown. In a preferred form, the zones are arranged on a natural slope so that the solids moving through the process steps cascade downward due to gravity. In areas where oil shale is mined, such natural contours are usually readily available.

Combustion zone 1 contains a bed fluidized by air entering through air inlet 10. Crushed and ground low grade oil shale generally unsuitable for retorting is added to the combustion zone to serve as fuel via inlet 11. The shale plus any supplemental fuels including sulfur bearing gas or solid fuels which may be required are burned in a fluid bed boiler assigned to heat boiler feedwater entering via conduit 13 to produce steam shown leaving via conduit 15.

In the process described herein, burned oil shale serves as heat transfer material. Supplemental heat transfer material, as for example sand, may be added if insufficient burned oil shale is available from the combustion zone. The hot burned oil shale from combustion zone 1 is transferred to pyrolysis zone 7 via conduit 17. Excess solids from the combustion zone, if any, are drawn off via conduit 19 for disposal.

The burned oil shale serving as heat transfer solids is mixed with raw, relatively rich oil shale entering pyrolysis zone 7 by means of inlet 21. Various retort designs may be used for pyrolyzing the oil shale in the pyrolysis zone. One particularly advantageous design for use with the process described herein is the staged turbulent bed design which employs a vertical retorting vessel containing a partially fluidized bed and internal baffles to control the mass movement of particles down through the retort. A full description of the staged turbulent bed may be found in U.S. Pat. No. 4,199,432. In the pyrolysis zone an inert stripping gas, e.g. recycled noncondensible retort gas, steam or natural gas, is employed to carry away the product vapors.

Product vapors leave the pyrolysis zone 7 via outlet 23 along with any entrained fine particles of shale. The fine solids are removed from the product vapors by cyclone 25. The product and any stripping gas present pass via line 27 to a product recovery zone 29. In the product recovery zone 29, condensed shale oil is separated from the noncondensible hydrocarbons and other gases.

Returning to the retorting zone 7, a mixture of pyrolyzed oil shale and heat transfer material pass via conduit 31 into combustion zone 3. Fine solids removed from the product vapors and lean oil shale are added to the combustion zone via conduits 33 and 35, respectively. In a manner very similar to that described for combustion zone 1, the carbonaceous residue present in the pyrolyzed oil shale and the low grade shale ae burned in a bed fluidized by air entering via 37 to generate steam from feedwater entering the boiler via line 39. The steam is recovered by line 41. The hot solids remaining after combustion pass via 43 to pyrolysis zone 9. Excess solids are removed from the system at 45. Alternately, the solids drawn off at 45 may be sent to a parallel retort (not shown). The operation of pyrolysis zone 9 and combustion zone 5 is the same as described above and a detailed description should not be necessary.

The steam generated in the combustion zone can be used for a number of purposes, such as to generate electricity or to strip the product vapors from the pyrolyzed oil shale in the retort. Although the fluidized bed boiler used to generate steam is one embodiment of the invention, it should be understood that other designs may be substituted in the combustion zone such as, for example, a lift pipe combustor. The arrangement outlined above, however, is a convenient means for the cogeneration of steam and shale oil. In addition, when the natural contour of the terrain is used to move the solids, a substantial saving of energy will be realized over a system employing a lift pipe or other means for raising the hot heat transfer material to the top of the pyrolysis zone. In addition, waste gases, such as retort gas or sour gas collected during processing of the shale oil may be recycled to the fluid bed boiler and burned cleanly to recover any caloric value it may have.

The inorganic residue that remains after the combustion of oil shale or retorted oil shale has the ability to sorb significant amounts of sulfur compounds formed in the combustor and retain them in the form of sulfates. See for example U.S. Pat. Nos. 4,054,492 and 4,069,132. Thus supplement fuels, such as for example sour gas and high sulfur coal or fuel oil, may be cleanly burned in the boiler without releasing sulfur pollutants in the flue gas. This also provides a convenient means for eliminating unwanted acid gas ($H_2S$) from the shipping of sour water and the need to desulfurize noncondensible retort gas before burning it as a supplemental fuel.

The process of this invention is generally used for recovering hydrocarbon vapors from particulate solids, such as oil shale which has been crushed and ground to a maximum particle size of about ½ inch or less. During crushing and grinding particles of various sizes are formed, ranging from a predetermined maximum to very fine materials. The maximum particle size that may be tolerated in the process will depend on the design of the combustion zone and the pyrolysis zone. Generally, ½ inch is a practical maximum diameter for processes of this nature, with a maximum diameter of about ¼ inch or less being preferred. In the case of oil shale, pyrolysis of the raw shale and subsequent combustion of the carbonaceous residue causes physical and chemical changes in the inorganic matrix which leads to the production of additional fines. These fines preferably are removed from the process and not allowed to accumulate to a point where they comprise a substantial amount of the solids present in the system. The fines are generally less desirable as heat transfer material than larger particles, as for example, those above about 100 mesh (Tyler Standard Sieve). In addition, the presence of very high levels of fines in the product vapors leads to downstream processing problems.

In most areas of the Western United States where oil shale is mined, the relatively rich oil shale, i.e., that shale containing about 20 gallons of shale per ton or more, is covered by a relatively lean overburden. This overburden or relatively low grade shale may be used as a supplemental source of fuel for the combustor. Alternate supplemental fuels include particulate coal, noncondensible hydrocarbons and acid gases from the separation zone, torch oil, etc. When burning either pyrolyzed or fresh oil shale, it is desirable to control the temperature and residence time of the particles in the combustion zone to prevent undue carbonate decomposition thus minimizing the need for supplemental boiler fuel. At temperatures above about 1500° F. the carbonates in the shale are converted to oxides, resulting in a loss of heat due to the endothermic nature of the reaction.

The raw oil shale entering the pyrolysis zone is heated to between about 850° F. and 1000° F., preferably between 900° F. and 950° F. to decompose the kerogen, i.e., the solid hydrocarbonaceous component of the oil shale. To accomplish this, hot heat transfer solids enter the pyrolysis zone at a temperature in the range of from about 1100° F. to 1500° F. and is mixed with raw oil shale in a predetermined ratio. Generally, a ratio of about 2:5 heat transfer solids to raw shale is used, however, this ratio will vary depending upon such factors as the heat transfer solids employed, its temperature, and the residence time of the solids in the pyrolysis zone.

One skilled in the art will recognize that the amount of hot heat transfer material will increase as the solids pass each step of the process. The increased volume of solids may be accommodated in the process by increasing the size of downstream combustor-retorts, by the addition of parallel combustor-retorts which branch out from the initial system, or by various combinations of the preceding. Alternatively, hot solids may be withdrawn from the system and discarded, although this may not be as economically desirable as the other approaches.

As noted above, a preferred design of the pyrolysis zone employs a staged turbulent bed to retort the oil shale or other hydrocarbonaceous solids. However, other retort designs employing packed beds, fluidized beds, screw mixers, etc., may be used to pyrolyze the solids. In most such retorting systems an inert gas, i.e., a nonoxidizing gas, is employed in the retorting zone to strip the hydrocarbonaceous vapors produced during pyrolysis. In systems employing a fluidized bed or semi-fluidized bed, the same inert gas will ususally also serve as a fluidizing gas. This gas may be noncondensible retort gas, steam, or natural gas.

Steam produced in the combustion zone by the boiler may be used to operate a steam turbine for the production of electricity. The steam may also be used as a stripping gas in the pyrolysis zone. In addition, heat recovered from excess solids leaving the process may be used to preheat combustion air used to produce additional steam.

From the above discussion, it should be understood that the spirit of the process that constitutes the invention may be carried out in various ways. The basic process is flexible and adaptable to use with various hydrocarbonaceous solids or component designs.

What is claimed is:

1. A process for pyrolyzing a first particulate hydrocarbonaceous solid in a series of alternating heating zones and pyrolysis zones, which comprises:

(a) burning a first fraction of a second particulate hydrocarbonaceous solid which is leaner than said first hydrocarbonaceous solid in the presence of oxygen in a first heating zone, thereby heating a heat transfer solid to a temperature sufficient to pyrolyze the first hydrocarbonaceous solid;

(b) mixing at least a portion of the hot heat transfer solid from the first heating zone with a first fraction of the first hydrocarbonaceous solid in a first pyrolysis zone, thereby heating the first fraction of the first hydrocarbonaceous solid to a pyrolyzing temperature, whereby volatile hydrocarbons and pyrolyzed solid containing a carbonaceous residue are formed;

(c) recovering the volatile hydrocarbons from the first pyrolysis zone as product vapors, and withdrawing pyrolyzed solid and heat transfer solid from the first pyrolysis zone;

(d) burning a second fraction of the second hydrocarbonaceous solid and the carbonaceous residue remaining in the pyrolyzed solid from the first pyrolysis zone in the presence of oxygen in a second heating zone, thereby forming additional heat transfer solid;

(e) mixing at least a portion of the hot heat transfer solid from the second heating zone with a second fraction of the first hydrocarbonaceous solid in a second pyrolysis zone, thereby heating the second fraction of the first hydrocarbonaceous solid to the pyrolyzing temperature, whereby volatile hydrocarbons and pyrolyzed solid containing a carbonaceous residue are formed; and (f) recovering the volatile hydrocarbons from the second pyrolysis zone as product vapors, and withdrawing pyrolyzed solid and heat transfer solid from the second pyrolysis zone.

2. The process of claim 1 which further comprises at least one additional pair of heating and pyrolysis zones arranged serially so that steps (d), (e), and (f) of claim 1 are repeated in each pair of zones.

3. The process of claim 1 wherein at least one of the heating zones comprises a fluidized bed.

4. The process of claim 3 wherein each of the heating zones comprises a fluidized bed.

5. The process of claim 1 wherein at least one of the pyrolysis zones comprises a staged turbulent bed.

6. The process of claim 5 wherein each of the pyrolysis zones comprises a staged turbulent bed.

7. The process of claim 1 wherein the first hydrocarbonaceous solid comprises oil shale.

8. The process of claim 1 wherein the second hydrocarbonaceous solid comprises oil shale.

9. The process of claim 8 wherein the heat transfer solid comprises burned oil shale.

10. The process of claim 8 wherein the heat transfer solid consists essentially of burned oil shale.

11. The process of claim 1 wherein the first hydrocarbonaceous solid is heated to a temperature between 850° F. and 1000° F. in each pyrolysis zone.

12. The process of claim 1 wherein an inert stripping gas is used to aid in the recovery of volatile hydrocarbons from each pyrolysis zone.

13. The process of claim 12 wherein the inert stripping gas comprises steam.

14. The process of claim 12 wherein the inert stripping gas comprises noncondensible retort gas.

15. The process of claim 12 wherein the inert stripping gas comprises natural gas.

16. The process of claim 1 wherein the alternating heating zones and pyrolysis zones are arranged on an incline so that solids pass from one zone to the next by gravity flow.

17. A process for pyrolyzing a particulate rich oil shale in a series of alternating heating zones and pyrolysis zones, which comprises:

(a) burning a first fraction of a lean oil shale in the presence of oxygen in a first fluidized bed heating zone, thereby forming a burned shale at a temperature sufficient to pyrolyze the rich shale;

(b) mixing at least a portion of the burned shale from the first heating zone with a first fraction of the rich oil shale in a first staged turbulent bed pyrolysis zone, thereby heating the first fraction of the rich oil shale to a pyrolyzing temperature, while introducing an inert stripping gas comprising steam into the first pyrolysis zone, whereby volatile hydrocarbons and pyrolyzed shale containing a carbonaceous residue are formed;

(c) recovering the volatile hydrocarbons from the first pyrolysis zone with the aid of the stripping gas as product vapors, and withdrawing pyrolyzed shale and burned shale from the first pyrolysis zone;

(d) burning a second fraction of lean oil shale and the carbonaceous residue remaining on the pyrolyzed shale from the first pyrolysis zone in the presence of oxygen in a second fluidized bed heating zone, thereby forming additional burned shale;

(e) mixing at least a portion of the burned shale from the second heating zone with a second fraction of the rich oil shale in a second staged turbulent bed pyrolysis zone, thereby heating the second fraction of the rich oil shale to a pyrolyzing temperature, while introducing an inert stripping gas comprising steam into the second pyrolysis zone; whereby volatile hydrocarbons and pyrolyzed shale containing a carbonaceous residue are formed; and (f) recovering the volatile hydrocarbons from the second pyrolysis zone with the aid of the stripping gas as product vapors, and withdrawing pyrolyzed shale and burned shale from the second pyrolysis zone.

18. The process of claim 17 wherein the alternating heating zones and pyrolysis zones are arranged on an incline so that solids pass from one zone to another by gravity flow.

* * * * *